US010746508B2

(12) United States Patent
Vardi

(10) Patent No.: US 10,746,508 B2
(45) Date of Patent: Aug. 18, 2020

(54) SIGHTING SYSTEM

(71) Applicant: SENSIGHT LTD., Kibbutz Nir Am (IL)

(72) Inventor: Ran Vardi, Tel Aviv (IL)

(73) Assignee: SENSIGHT LTD., Kibbutz nir Am (IL)

( * ) Notice: Subject to any disclaimer, the term of this patent is extended or adjusted under 35 U.S.C. 154(b) by 0 days.

(21) Appl. No.: 15/544,259

(22) PCT Filed: Jan. 17, 2016

(86) PCT No.: PCT/IL2016/050054
§ 371 (c)(1),
(2) Date: Jul. 18, 2017

(87) PCT Pub. No.: WO2016/116927
PCT Pub. Date: Jul. 28, 2016

(65) Prior Publication Data

US 2018/0266791 A1 Sep. 20, 2018

(30) Foreign Application Priority Data

Jan. 19, 2015 (IL) ..... 236802

(51) Int. Cl.
*F41G 1/30* (2006.01)
*F41G 3/16* (2006.01)
(Continued)

(52) U.S. Cl.
CPC ..... *F41G 3/165* (2013.01); *F41G 1/30* (2013.01); *F41G 1/473* (2013.01); *F41G 11/001* (2013.01)

(58) Field of Classification Search
CPC ... F41G 3/165; F41G 1/30; F41G 3/16; F41G 3/06
See application file for complete search history.

(56) References Cited

U.S. PATENT DOCUMENTS 7,738,082 B1 * 6/2010 Peters ..... G01C 3/22 356/4.01
9,335,124 B2 * 5/2016 Maryfield ..... F41G 1/30
(Continued)

FOREIGN PATENT DOCUMENTS

EP 2 416 201 2/2012
WO WO 2014/125471 8/2014

OTHER PUBLICATIONS

Search Report dated Aug. 21, 2018 for application No. EP16739880.9.

(Continued)

*Primary Examiner* — Stephen Johnson
(74) *Attorney, Agent, or Firm* — Pearl Cohen Zedek Latzer Baratz LLP

(57) ABSTRACT

Sighting systems and respective methods are provided, which utilize one or more image sensors to capture target images and display them in a display device, in association with a sight symbol, at a specified region which is reflected toward the user. Another part of the display device is used to provide a graphical user interface which allows the user adjust the sight symbol for boresighting and for further operational needs. The display device and associated optical elements are held by a housing attached to the firearm. Internal and/or external information may be presented on the reflected display part to provide and enhance the displayed information. The sighting system may utilize a single flat touchscreen to provide both the image with the sight symbol, which is reflected from the touchscreen toward the user, and the user interface.

18 Claims, 5 Drawing Sheets

(51) Int. Cl.
*F41G 11/00* (2006.01)
*F41G 1/473* (2006.01)

(56) References Cited

U.S. PATENT DOCUMENTS

| | | | | |
|---|---|---|---|---|
| 2010/0301116 | A1* | 12/2010 | Bennetts | F41G 1/12 235/404 |
| 2012/0030985 | A1 | 2/2012 | Mauricio | |
| 2012/0050144 | A1 | 3/2012 | Morlock | |
| 2012/0097741 | A1 | 4/2012 | Krcher | |
| 2012/0102808 | A1* | 5/2012 | Matthews | F41G 1/30 42/113 |
| 2014/0075820 | A1* | 3/2014 | Ben-Ami | F41G 1/30 42/123 |
| 2014/0305024 | A1* | 10/2014 | Russell | F41C 27/00 42/124 |
| 2015/0008260 | A1* | 1/2015 | Volfson | G01S 17/107 235/404 |
| 2016/0202021 | A1* | 7/2016 | Roman | F41G 3/06 345/633 |

OTHER PUBLICATIONS

International Search Report of PCT Application No. PCT/IL2016/050054 dated May 17, 2016.

* cited by examiner

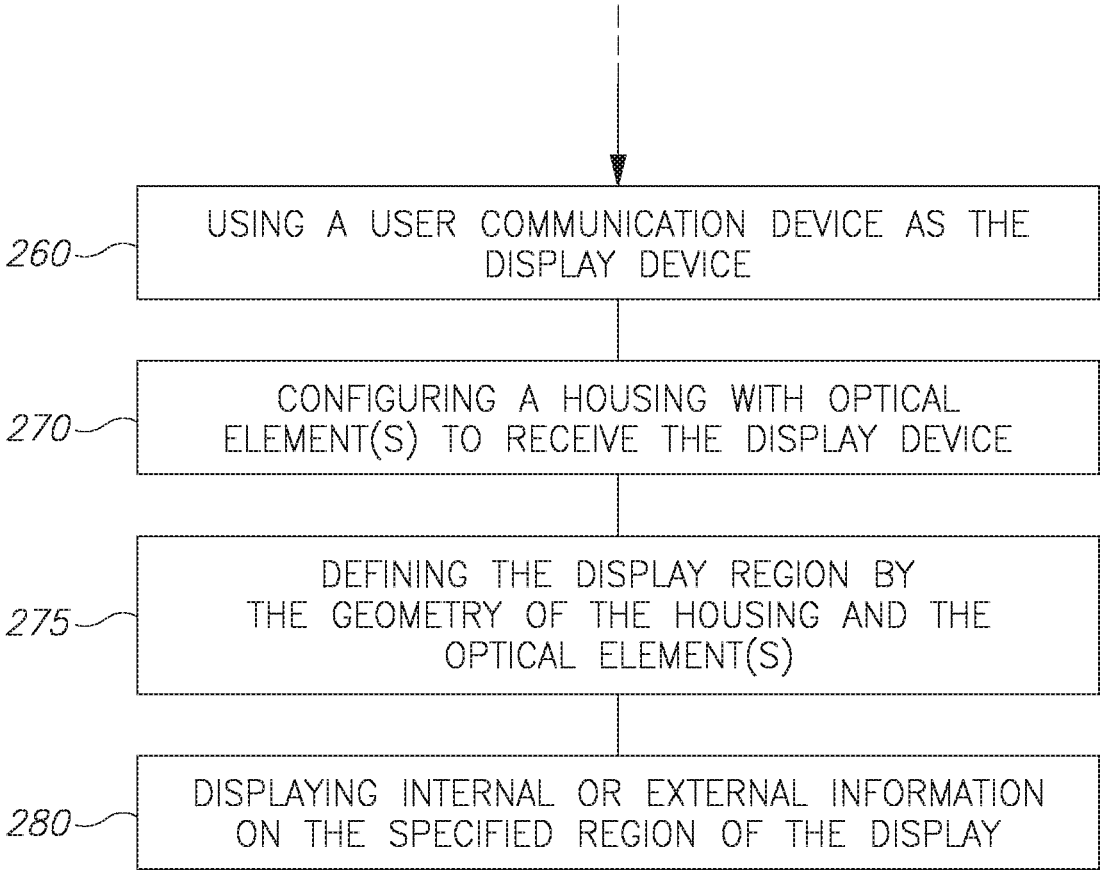
Figure 2 (cont. 1)

SIGHTING SYSTEM

CROSS-REFERENCE TO RELATED APPLICATIONS

This application is a National Phase Application of PCT International Application No. PCT/IL2016/050054, International Filing Date Jan. 17, 2016, claiming priority of Israeli Patent Application No. 236802, filed Jan. 19, 2015, which are hereby incorporated by reference.

BACKGROUND OF THE INVENTION

1. Technical Field

The present invention relates to the field of sighting systems, and more particularly, to digital imaging sighting systems.

2. Discussion of Related Art

Sight improvements are carried currently in several directions. One direction optically introduces illumination into the sight, another direction implements holographic sights and a third direction is enhancing telescopic sights.

SUMMARY OF THE INVENTION

One aspect of the present invention provides a comprising: at least one image sensor, a display device having a display, the device configured to receive images from the at least one image sensor and display the received images on a specified region of the display along with a sight symbol, a housing attachable to a firearm and configured to receive the display device, an optical element set within the housing to reflect the specified region of the display towards a user of the firearm, and a graphical user interface (GUI), operable outside the specified region of the display, the GUI configured to enable the user to adjust at least a position of the sight symbol in the specified region of the display, wherein the GUI comprises a touchscreen.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1A:
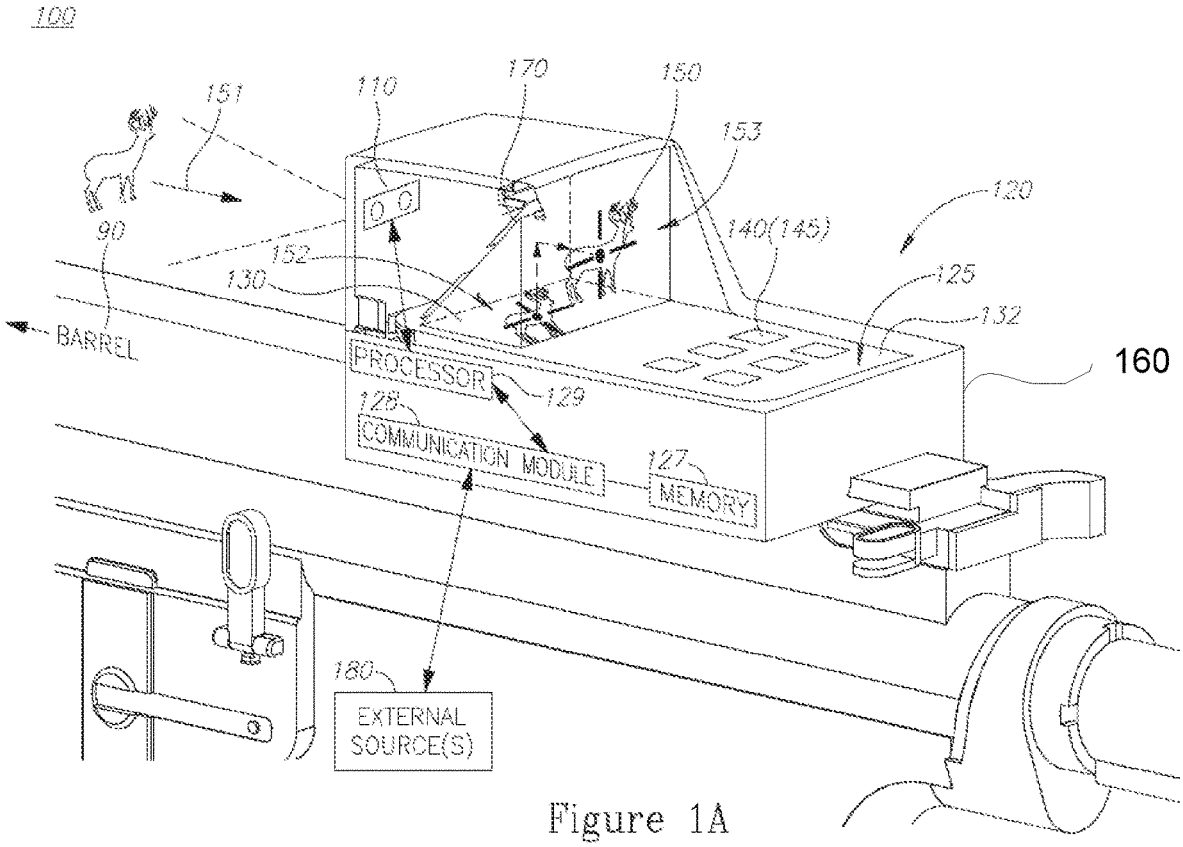
FIGS. 1A-1D are high level schematic illustrations of sighting systems, according to some embodiments of the invention.

Prior to the detailed description being set forth, it may be helpful to set forth definitions of certain terms that will be used hereinafter. The term "sight symbol" as used in this application refers to any graphic element which is added to an image or a video stream to denote a location on the image or video images. For example, the term "sight symbol" as used in this application refers to reticles, dots, lines, circles, arrows and so forth. Furthermore, while used in singular, the term "sight symbol" may comprise multiple graphical elements and graphical elements relating to multiple aiming points, i.e., the sight symbol may be configured to indicate multiple targets.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Sighting systems and respective methods are provided, which utilize one or more sensors to capture target images and display them in a display device, in association with a sight symbol, at a specified region which is reflected toward the user. Another part of the display device is used to provide a graphical user interface which allows the user adjust the sight symbol for boresighting and for further operational needs. The display device and associated optical elements are held by a housing attached to the firearm. Internal and/or external information may be presented on the reflected display part to provide and enhance the displayed information. The sighting system may utilize a single flat touchscreen to provide both the image with the sight symbol, which are reflected from the touchscreen toward the user, and the user interface. In certain embodiments, the sighting systems and respective methods may be used for hunting purposes.

Figure 1B:
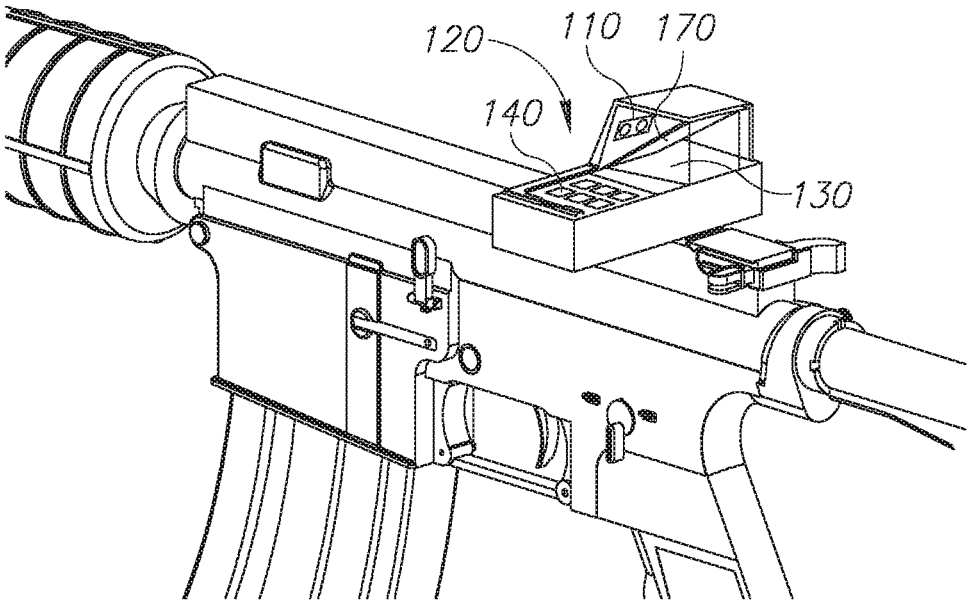
Figure 1C:
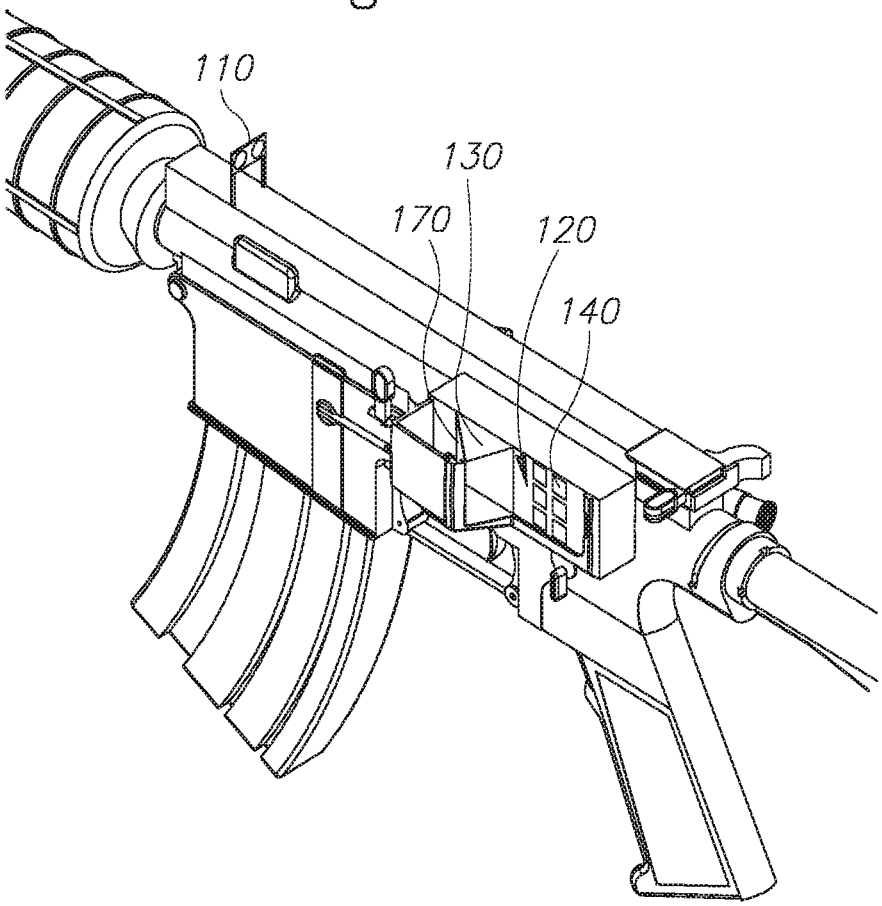
Figure 1D:
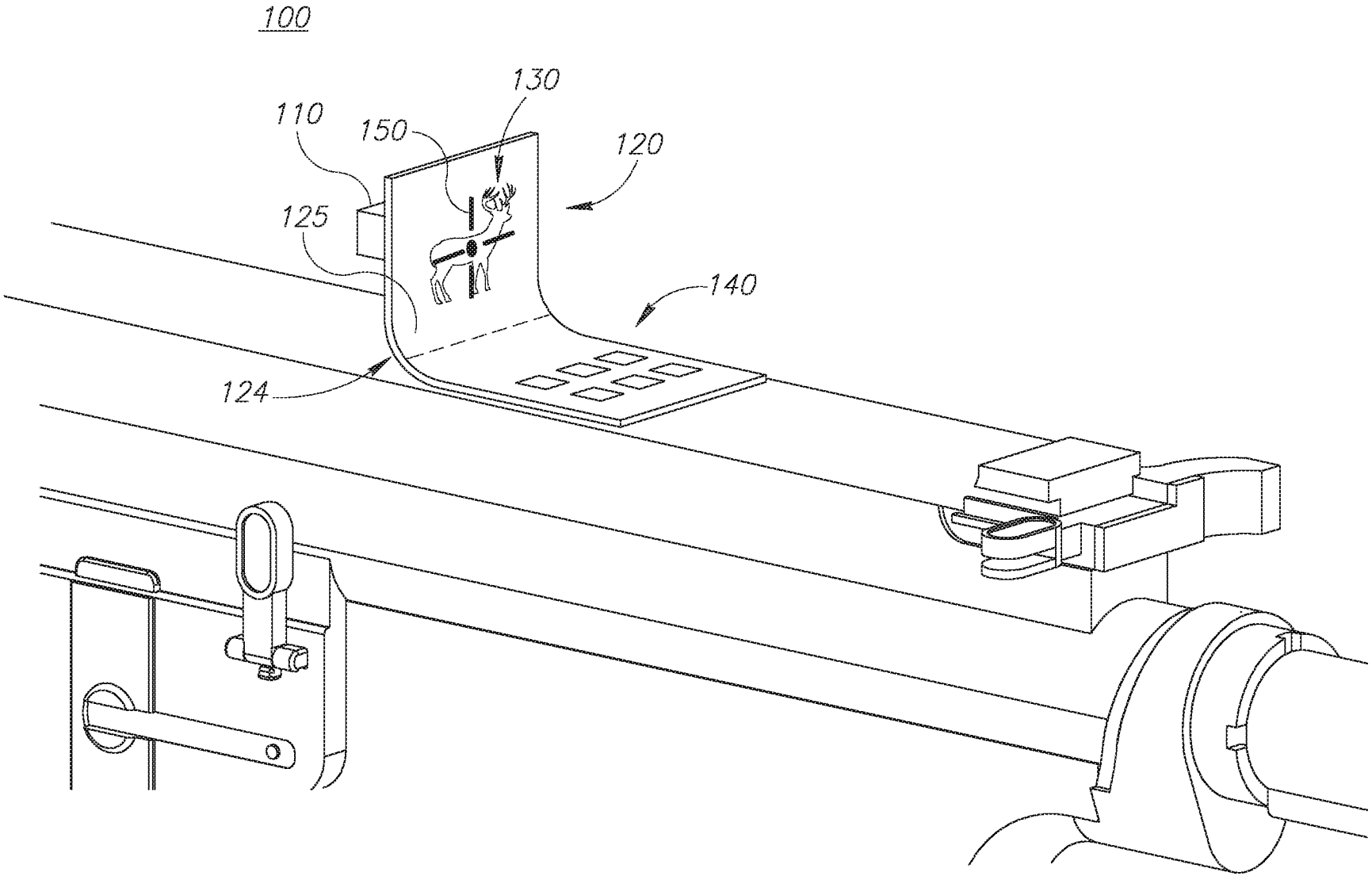

FIGS. 1A-1D are high level schematic illustrations of sighting systems 100, according to some embodiments of the invention. Sighting system 100 is illustrated mounted on a firearm 90. The view in FIG. 1A is perspective, with a longitudinal section through sighting system 100. FIGS. 1B-1D schematically illustrate alternative mounting configurations of sighting system 150 on firearm 90.

Sighting system 100 comprises at least one image sensor 110 (e.g., visual range sensor(s) and/or infrared sensor(s)) and a display device 120 having a display 125. Display 125 may be flat or curved. Device 120 is configured to receive images 151 (e.g., of a target) from image sensor(s) 110 (e.g., by wire or wirelessly) and display (152) the received images on a specified region 130 of the display along with a sight symbol 150. Sight symbol 150 may comprise any graphic element (e.g., reticle(s), dot(s), line(s), circle(s), arrow(s) etc.) which is added to an image or a video stream at region 130 to denote a location on the image or video images. In certain embodiments, sight symbol 150 may comprise multiple graphical elements and graphical elements relating to multiple aiming points. Sight symbol 150 may be configured to indicate multiple targets.

A processor 129 in display device 120 may be configured to replace and enable adjusting the place of sight symbol 150 in image 152. Data and/or data streams from image sensor(s) 110 may be passed through and processed by processor 129, e.g. to adjust or enhance the images, adjust overlay sight symbol 150, measure various image and target parameters etc. Sighting system 100 may comprise a memory 127, holding database(s) of internal data relating e.g., to target types, geographic and environment data and so forth. The internal data may be used to enhance displayed images 152 with respect to captured images 151. Processor 129 may derive image features such as identification of objects or of faces and use internal data from memory 127 to provide related information.

Sighting system 100 further comprises an optical element 170 (e.g., a prism or a mirror) configured to reflect specified region 130 of display 125 towards the user of firearm 90 so that image 152 with sight symbol 150 is projected toward the user as image 153 with sight symbol 150. Optical element 170 may be configured to reflect specified region 130 perpendicularly to display 125.

Sighting system 100 may further comprise a housing 160 attachable to a firearm 90 and configured to receive display device 120. Optical element may be set within housing 160. Housing 160 and/or display device 120 may be attached to firearm 90 in any of various operational ways. For example, FIG. 1A illustrates attaching housing 160 and display device 120 on top of firearm 90 with their long axis along or parallel to the line of sight between the user and the target. In another example, FIG. 1B illustrates attaching housing 160 and display device 120 on top of firearm 90 with their long axis transverse (e.g., perpendicular or inclined at an angle) to the line of sight between the user and the target. In yet another example, FIG. 1C illustrates attaching housing 160 and display device 120 on the side of firearm 90 with their long axis along or parallel to the line of sight between the user and the target. In any of the configurations, optical element 170 may be positioned to reflect specified region 130 of display 125 towards the user of firearm 90. Sighting system 100 may be designed to reduce the exposure of the weapon and the user. The attachment configurations may further reduce the signature of the weapon and user. FIG. 1D schematically illustrates embodiments in which display device 120 may comprise curved display 125 (see curved section 124), having specified region 130 of display 125 directly curved to be comfortably visible to the user, e.g., at 90° to residual area 132 holding GUI 140 (see below). Certain embodiments comprise separate flat display parts (not shown) which are placed at an angle, e.g., perpendicularly, in place of curve 124 in display 125 (illustrated in FIG. 1D).

Housing 160 may be configured to set display device 120 horizontally. Housing 160 may be mounted on firearm 90 by any rail system (e.g., Weaver or Picatinny rail mounts) to enable using sighting system 100 and specifically sight symbol 150 may be boresighted with respect to firearm 90 to correctly indicate the predicted impact point on the target.

Display device 120 may be a user communication device (e.g., a smartphone) or part thereof. Display device 120 may comprise a touchscreen as display 125 and be associated with processor 129 and/or memory 127 and/or communication module 128. Housing 160 may be configured to enable insertion of display device 120 (e.g., of the user communication device) into housing 160 and define specified region 130 with respect to optical element(s) 170. Image sensor(s) 110 may be mechanically supported by housing 160, e.g., attached thereto or associated therewith.

Display device 120 may further comprise a graphical user interface (GUI) 140 (e.g., a touchscreen). GUI 140 may be operable outside specified region 130 of display 125, for example over an area 145 (i.e. a GUI area 145 dedicated for GUI 140) in residual area 132 of display 125. GUI 140 may be configured to enable a user to adjust at least a position of sight symbol 150 in specified region 130 of display 125, to boresight sight symbol 150 with respect to firearm 90. In certain embodiments, with display device 120 as a user communication device such as a smartphone, display 125 of the user communication device may be separated into display region 130 which is reflected via optical element 170 and display region 132 with GUI 140 (over the whole region 132 or part thereof). Buttons and controllers (e.g., device specific or part of the user communication device) which are beyond display 125 may also be used to adjust any of the features of sighting system 100 such as sight symbol 150, characteristics of display 130 and parameters of GUI 140. In any spatial configuration of housing 160 and display device 120, GUI 140 may be positioned on display 125 in a conveniently operable, possibly user-adjustable position and manner.

Display device 120 may comprise a touchscreen as display 125 with specified region 130 reflected via optical element(s) 170 to the user and with residual area 132 in which GUI area 145 is defined. GUI area 145 may encompass whole residual area 132 or part thereof. GUI area 145 may be adjustable and residual area 132 may comprise one or more GUI's 140.

GUI 140 may be further arranged to enable a user adjust at least one of: a type of sight symbol 150, a color thereof, a position thereof with respect to an estimated range, and graphical or animation parameters of sight symbol 150. The user may adjust via GUI 140 the color, position or type of sight symbol 150 according to selected ranges, munition or scenario. The user may adjust via GUI 140 displayed image 130, either with respect to parameters thereof (e.g., brightness, contrast, magnification) and/or with respect to the operation of image sensor(s) 110, e.g., optical magnification, type of sensor (e.g., switching visual range and infrared sensors) or image processing parameters. GUI 140 may be further arranged to enable a user adjust any display parameters. At least some of the image processing may be carried out by processor 129.

GUI 140 may be configured to operate at a section 132 of display 125 that is closer to the user than specified display region 130, while displayed region 130 which is more remote from the user, is reflected to be viewed approximately along the user's line of sight to the target.

Display device 120 may comprise a communication module 128. In certain embodiments, display device 130 may be further arranged to communicate with at least one external information source 180 and display information therefrom at specified region 130. For example, external information may comprise geographic data, hunting-related data, data about the targets, instructions, and so forth.

Figure 2:
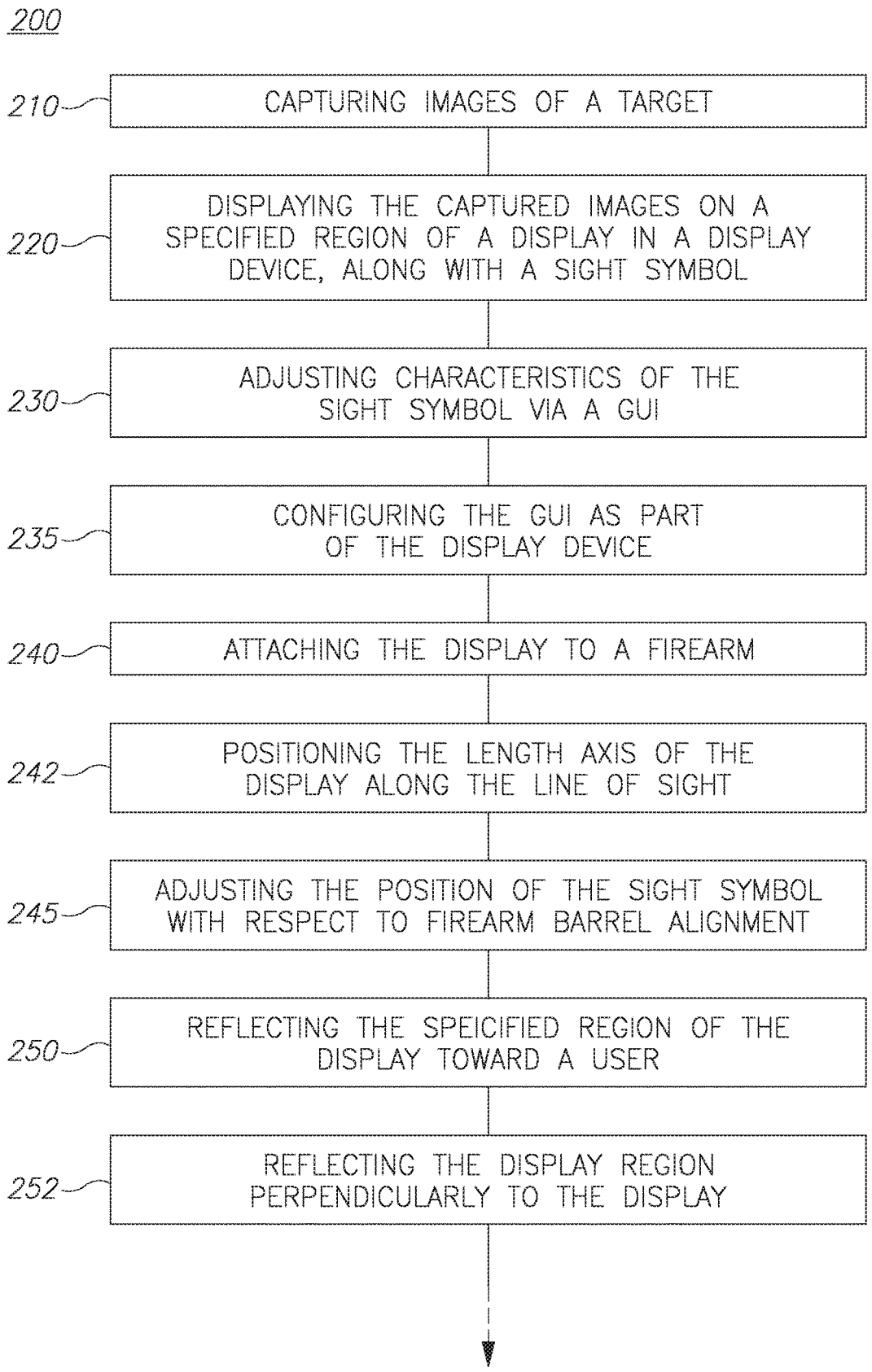
FIG. 2 is a high level schematic flowchart of a method, according to some embodiments of the invention.

FIG. 2 is a high level schematic flowchart of a method 200, according to some embodiments of the invention. At least parts of stages in method 200 may be carried out by processor 129, for example using computer program product (s) comprising non-transitory computer readable storage media having computer readable program embodied therewith and configured to carry out any part of relevant stages of method 200.

Method 200 comprises capturing images of a target (stage 210), displaying the captured images on a specified region of a display in a display device, along with a sight symbol, (stage 220) and reflecting the specified region of the display towards a user (stage 250), e.g., perpendicularly to the display (stage 252).

Method 200 may further comprise attaching the display to a firearm (stage 240), in a non-limiting example position the length axis of the display along the line of sight of the firearm (stage 242) and adjusting the position of the sight symbol with respect to the firearm barrel alignment (stage 245).

Method 200 may further comprise adjusting, via a graphical user interface (GUI), the sight symbol in the specified region of the display (stage 230) with respect to at least one of: a position thereof, a type thereof, a color thereof, a position thereof with respect to an estimated range, and graphical or animation parameters of the sight symbol.

Method 200 may further comprise configuring the GUI as part of the display device (stage 235). Method 200 may further comprise using a user communication device as the display device (stage 260).

Method 200 may further comprise configuring a housing having at least one optical element to receive the display device (stage 270) wherein the specified region of the display is defined by a geometry of the housing and the at least one optical element (stage 275).

Method 200 may further comprise displaying internal and/or external information on the specified region of the display (stage 280).

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A sighting system comprising:

at least one image sensor, a display device comprising:

a display, the device configured to receive images from the at least one image sensor and display the received images on a specified region of the display along with a sight symbol; and a graphical user interface (GUI), operable outside the specified region of the display, the GUI configured to enable the user to adjust at least a position of the sight symbol in the specified region of the display, wherein the GUI comprises a touchscreen;

a housing attachable to a firearm and configured to receive the display device; and an optical element set within the housing to reflect the specified region of the display towards a user of the firearm.

2. The sighting system of claim 1, wherein the GUI is further arranged to enable a user adjust at least one of: a type of the sight symbol, a color thereof, a position thereof with respect to an estimated range.

3. The sighting system of claim 1, wherein the GUI operates at a section of the display that is closer to the user than the specified display region.

4. The sighting system of claim 1, wherein the optical element is configured to reflect the specified region perpendicularly to the display.

5. The sighting system of claim 4, wherein the housing and the display device are attached on a side of a firearm with a long axis along or parallel to a line of sight between a user and a target.

6. The sighting system of claim 1, wherein the optical element is at least one of a prism and a mirror.

7. The sighting system of claim 1, wherein the at least one image sensor is mechanically supported by the housing.

8. The sighting system of claim 1, wherein the display device receives images from the at least one image sensor by wire or wirelessly.

9. The sighting system of claim 1, wherein the display device receives images from the at least one image sensor via a processor configured to process the images.

10. The sighting system of claim 1, wherein the at least one image sensor comprises at least one of a visual range sensor and an infrared sensor.

11. The sighting system of claim 1, wherein the display device is part of a user communication device.

12. The sighting system of claim 11, wherein the housing is configured to enable insertion of the user communication device into the housing and wherein the display of said user communication device is separated into a display region reflected by the optical element and a display region with said GUI.

13. The sighting system of claim 1, wherein the display device is further arranged to communicate with at least one external information source and display information therefrom at the specified region.

14. A method comprising:

capturing images of a target;

displaying the captured images on a specified region of a display in a display device, along with a sight symbol;

reflecting the specified region of the display towards a user; and adjusting, via a graphical user interface (GUI) as part of the display device, the sight symbol in the specified region of the display.

15. The method of claim 14, further comprising positioning a length axis of the display device along a line of sight of a firearm and adjusting the position of the sight symbol with respect to a firearm barrel alignment.

16. The method of claim 14, wherein the adjusting is with respect to at least one of: a position of the sight symbol, a type thereof, a color thereof, a position thereof with respect to an estimated range.

17. The method of claim 14, wherein the reflecting is carried out perpendicularly to the display.

18. The method of claim 14, further comprising using a user communication device as the display device.

* * * * *